United States Patent [19]

Obuch

[11] 4,040,700

[45] Aug. 9, 1977

[54] ELECTRICAL TERMINATING DEVICE

[75] Inventor: Edward A. Obuch, Linden, N.J.

[73] Assignee: Amerace Corporation, New York, N.Y.

[21] Appl. No.: 661,012

[22] Filed: Feb. 24, 1976

[51] Int. Cl.[2] ..... H01R 9/08

[52] U.S. Cl. ..... 339/95 R; 339/246; 339/258 S

[58] Field of Search ..... 339/95, 246, 263, 258

[56] References Cited

U.S. PATENT DOCUMENTS

| | | | |
|---|---|---|---|
| 781,686 | 2/1905 | Sibley | 339/95 R |
| 2,968,018 | 1/1961 | Hubbell | 339/95 R |
| 3,486,158 | 12/1969 | Soltysik et al. | 339/95 R |

*Primary Examiner*—Joseph H. McGlynn
*Attorney, Agent, or Firm*—S. Michael Bender; Ken Richardson

[57] ABSTRACT

In an electrical terminating device wherein a conductive element, such as a bared conductor or a terminal contact, is secured to a terminal member by clamping the conductive element between a clamping screw and the terminal member, a resiliently deflectable cantilevered tang is struck from the terminal member and engages the conductive element, tending to confine the conductive element against longitudinal pull-out and lateral squeeze-out from between the clamping screw and the terminal member. The tang may be twisted or otherwise deformed to better present sharp gripping edges to the conductive element.

14 Claims, 6 Drawing Figures

ELECTRICAL TERMINATING DEVICE

The present invention relates generally to electrical terminating devices and pertains, more specifically, to wire terminating devices of the type wherein an electrically conductive element, such as a wire conductor or a terminal contact, is clamped between a clamping means and a terminal member to terminate or make common any number of wire conductors or to connect the wire conductors to further circuitry.

A wide variety of electrical terminating devices is available at present in the form of barrier blocks, feed-through blocks and terminal strips for such uses as making connections at printed circuit boards, for wire-wrap termination, for hand-solder operations and for quick-connect splices, among other uses. Usually, these terminating devices employ an insulating block, a terminal member and some means, such as a clamping screw, to clamp a conductor, in the form of a wire or a terminal contact, against the terminal member. Many features have been provided for retaining the terminal member in the insulating block, and for improving the threaded connection between the clamping screw and the terminal member. However, improvements in the way in which the wires or contacts are connected to the terminal member for a sound electrical connection together with a good mechanical connection largely have been limited to the provision of bumps or serrations in the terminal member, and variations in the configuration of the clamping screw head or pressure plate employed to urge the conductor against the terminal member.

A common problem with existing terminating devices, such as barrier blocks, is the tendency for large diameter wire to be squeezed-out laterally from under the head of the clamping screw, or from beneath a pressure plate, when the wire is being secured against the terminal member in the terminating device. Such a condition can lead to a faculty electrical connection as well as a poor mechanical connection. In addition, in barrier blocks, and like devices, a barrier of dielectric material usually is located adjacent the clamping screw and the wedging action of the squeezed-out wire against the barrier can cause the barrier to fracture. Other problems arise where terminal contacts in the form of lugs are to be clamped in place, rather than wire conductors. For example, in the tightening of a clamping screw head against a spade lug there is a tendency for the spade lug to be pushed out from beneath the screw head. Where a ring lug is used in place of a spade lug, the ring lug tends to turn about the axis of the screw, which can bring portions of the ring lug or the associated conductor dangerously close to an adjacent circuit. Optional quick-connect devices also can be affected adversely in a similar manner.

It is an object of the present invention to provide an electrical terminating device in which an electrically conductive element, such as a wire conductor or a terminal contact, may be captured positively beneath a clamping surface provided by a screw head, a pressure plate or the like, without being squeezed-out laterally, pushed out longitudinally, or turned about an axis of rotation during clamping.

Another object of the invention is to provide an electrical terminating device of the type described above and in which the configuration of the terminal member constitutes a minimal departure from conventional structures in terms of compactness and ease of manufacture, but significantly reduces the above-outlined problems.

Still another object of the invention is to provide an electrical terminating device which attains improved electrical and mechanical connections between a conductive element and a terminal member with minimal structural deviation from conventional, accepted structures.

A further object of the invention is to provide an electrical terminating device of the type described which is exceptionally well-adapted to making good connections between any one of a variety of conductive elements, such as solid wires, spade lugs ring lugs, quick-connect devices, and like contacts, and the terminal member of the device.

A still further object of the invention is to provide an electrical terminating device of the type described wherein not only the conductive element is clamped against the terminal member with greater integrity, but the clamping means, such as a clamping screw, is better secured against inadvertent loosening.

Another object of the invention is to provide an electrical terminating device of improved performance which can be fabricated economically in large numbers of uniform quality.

The above objects, as well as still further objects and advantages, are attained by the invention which may be described briefly as providing, in an electrical terminating device of the type having an electrical terminal member and a clamping means for detachably connecting a conductive element to the terminal member, the improvement comprising an electrical terminal member having a platform for receiving a conductive element to be detachably connected to the terminal member, clamping means including a clamping surface juxtaposed with the platform and selectively movable toward and away from the platform for selectively clamping or releasing the conductive element from between the clamping surface and the platform when the conductive element extends in a longitudinal direction between the clamping surface and the platform, at least one resiliently deflectable cantilevered projection unitary with the terminal member and extending laterally relative to the longitudinal direction, upwardly toward the clamping surface, and at an acute angle to the platform such that upon clamping the conductive element between the clamping surface and the platform, the projection will be deflected resiliently and will establish a resilient clamping force upon the conductive element tending to confine the condutive element between the clamping surface and the platform.

The invention will be more fully understood, while still further objects and advantages thereof will become apparent, in the following detailed description of embodiments of the invention illustrated in the accompanying drawing, in which.

Figure 1:
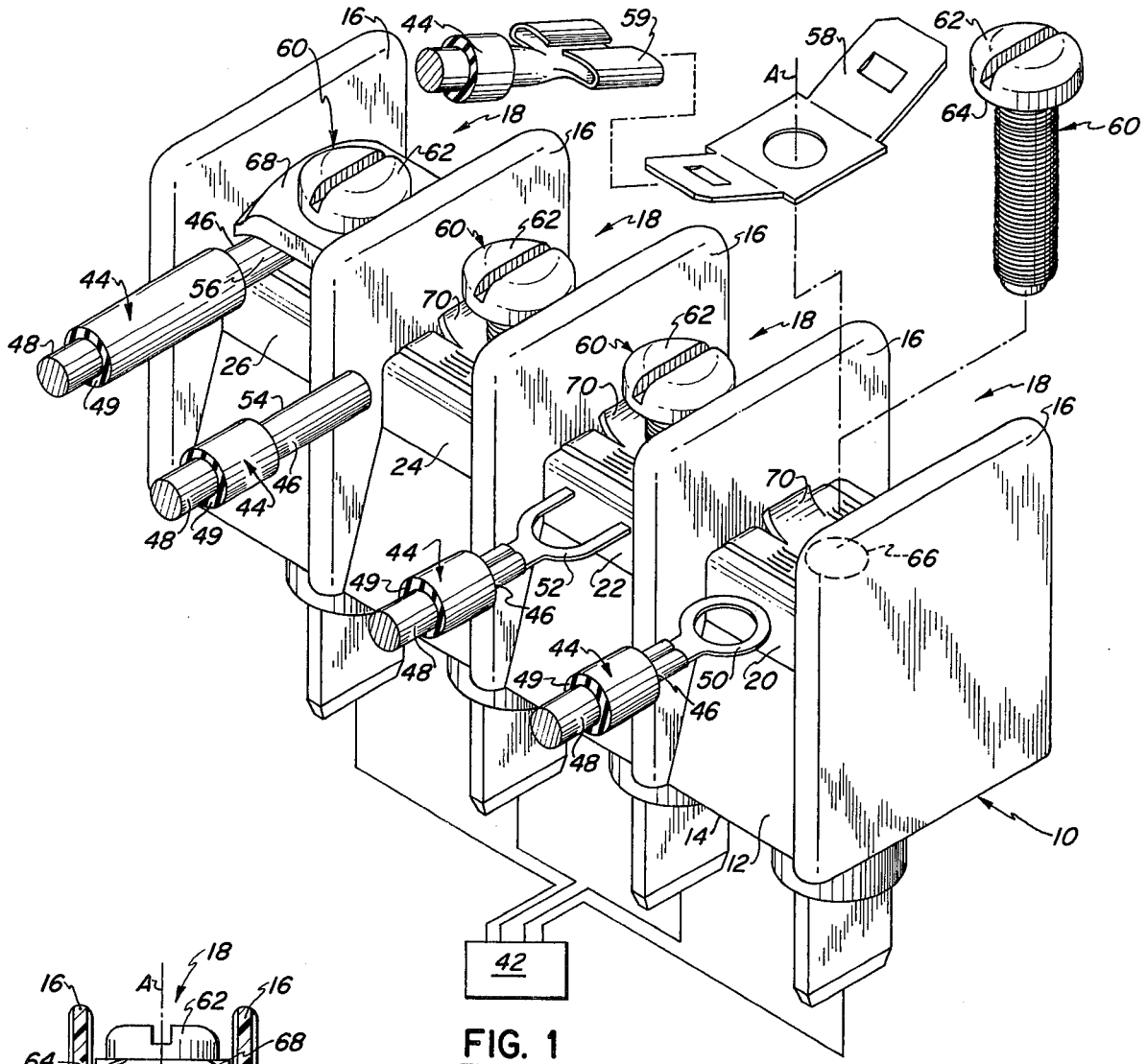
FIG. 1 is a perspective view of an electrical terminating device constructed in accordance with the invention for connection to a variety of conductive elements.

Referring now to the drawing, and especially to FIG. 1 thereof, an electrical terminating device constructed in accordance with the invention is illustrated in the form of a single-screw barrier block 10 constructed for use with printed circuit boards and panels. Barrier block 10 has a body 12 of dielectric material which is preferably molded of a synthetic resin material to provide a unitary base 14 and spaced barriers 16 which divide the base 14 into sections 18. While a barrier block of the type illustrated can be constructed with any desired number of sections 18, barrier block 10 is shown with four sections 18, each identified individually as section 20, 22, 24 and 26, for purposes of illustrating various features of the present invention.

Figure 2:
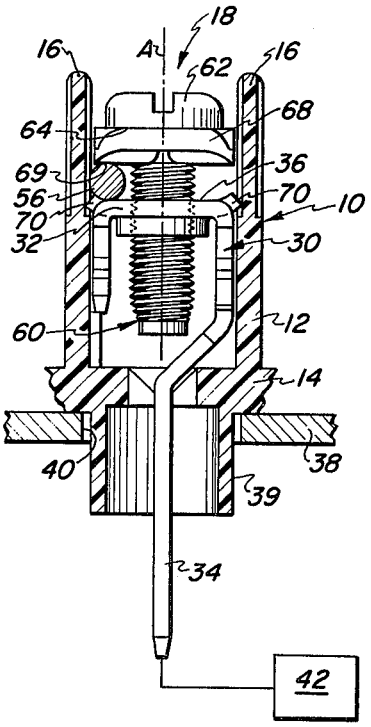
FIG. 2 is a fragmentary front elevational veiw showing a portion of the electrical terminating device.

Turning now to FIG. 2, as well as to FIG. 1, each section 18 is provided with an electrical terminal member shown in the form of a terminal 30 of conductive metallic material. Terminal 30 is secured within base 14 and includes a platform 32 at the uppermost end of the terminal and an integral lug 34 at the lowermost end. Platform 32 has a generally planar uppermost face 36, while lug 34 extends in a direction generally normal to the plane of platform face 36. Each terminal 30 is secured within base 14 by barbs 37 which grip the material of body 12 to hold the terminal firmly within the base. Where terminal 30 is to be used in a barrier block of the type which does not require a feed-through lug, such as lug 34, the lug may be eliminated by deleting that portion of terminal 30 below line D in FIG. 3, thus providing terminal 30 with a configuration which is generally symmetrical about a vertical plane, the trace of which is shown at line P.

Barrier block 10 is to be affixed to a panel, illustrated at 38 in FIG. 2, and base 14 is provided with a turret 39 projecting downwardly at each lug 34 for reception within a corresponding aperture 40 in the panel. Lug 34 projects beyond turret 39 to be connected to an electrical circuit shown diagrammatically at 42.

External electrical wires 44 are to be connected to circuit 42 through barrier block 10 by securing a conductive element, carried at the terminal end 46 of each wire 44, to a corresponding terminal 30. Each wire 44 has a central conductor 48 and a covering 49 of insulation. For the purposes of illustration, examples of various conductive elements are shown in the form of either electrical contacts, such as a ring lug 50 affixed to the conductor 48 of the wire 44 which is to be connected at section 20, and a spade lug 52 affixed to the conductor 48 of the wire 44 which is to be connected at section 22, or merely bared portions 54 and 56 of conductors 48 of wires 44, one of which is about to be connected at section 24, and the other of which is connnected at section 26. Another alternative conductive element is shown in the form of an element 58 of a quick-connect device which can be secured to a terminal 30 to permit a mating element 59, which is affixed to still another wire 44, to be connected quickly to terminal 30.

Clamping means are provided for securing each conductive element to a corresponding terminal 30. Each of the illustrated clamping means is shown to include a threaded fastener in the form of a clamping screw 60 having a screw head 62 with a clamping face 64. Screw 60 is received within a complementary threaded aperture 66 in the platform 32 such that clamping face 64 can be moved toward and away from the confronting platform face 36 by rotation of clamping screw 60 about the screw axis A. Where it is desired, a pressure plate such as captive clamp 68 may be placed beneath the screw head 62 so that the lower face 69 of the captive clamp serves as a clamping surface to hold a conductive element in place upon a platform 32. Where no captive clamp is employed, the clamping face 64 of the screw head 62 serves as the clamping surface.

When a conductive element, such as a bared conductor portion 56, for example, is placed between a clamping surface and the confronting face 36 of the platform 32 of a terminal 30 and the clamping surface is moved toward the conductive element to clamp the bared portion 56 between the clamping surface and the platform, there is a tendency for the bared portion 56 to be squeezed-out from beneath the clamping surface in a lateral direction, relative to the longitudinal direction in which bared portion 56 extends. Where such lateral movement of bared portion 56 is permitted without restraint, the bared portion could move either partially or completely out of captivity, resulting in either a poor electrical and mechanical connection, or no connection at all. A large diameter bared portion 56 can bear against the adjacent barrier 16 with a great enough force to fracture the barrier 16 or the base 14 of the body 12 itself.

Figure 3:
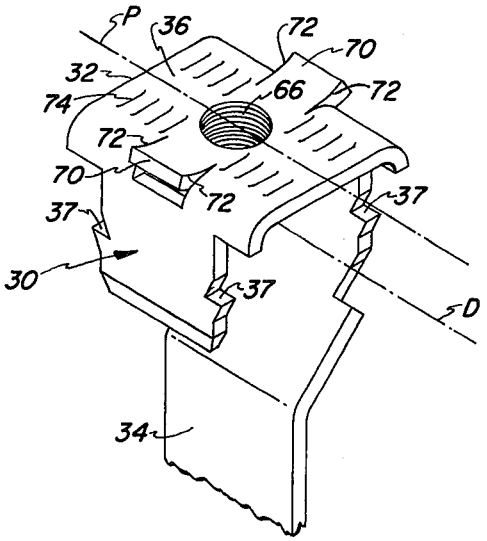
FIG. 3 is an enlarged perspective view of the terminal member of the electrical terminating device.
Figure 4:
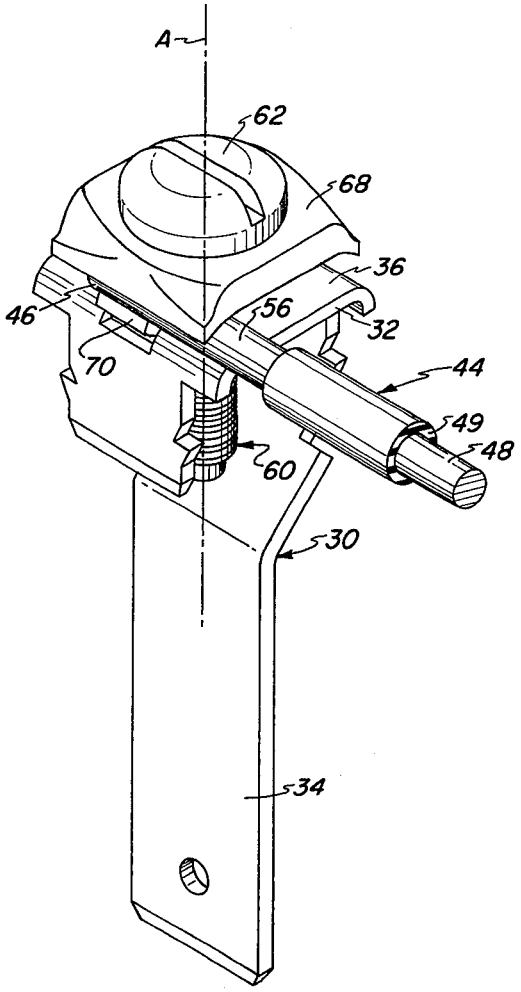
FIG. 4 is an enlarged perspective view of the terminal member of the electrical terminating device, with a conductive element secured thereto.

As best seen in FIGS. 3 and 4, as well as in FIG. 2, in order to preclude such deleterious lateral movement of bared portion 56, a resiliently deflectable cantilevered projection is provided at the upper face 36 of platform 32 in the form of a tang 70. Tang 70 extends laterally, relative to the longitudinal direction of extent of bared portion 56, and upwardly toward the clamping surface at an acute angle to the face 36 of platform 32. Upon movement of the clamping surface downwardly against bared portion 56, the tang 70 is deflected resiliently and establishes a resilient clamping force upon bared portion 56 tending to confine the bared portion between the clamping surface and the platform 32, thus impeding lateral movement of bared portion 56 and effecting a good electrical and mechanical connection between the bared portion 56 and the terminal 30. In addition, deflection of the tang 70 generates a resilient locking force which tends to secure the screw 60 against inadvertent loosening.

Tang 70 also provides sharp edges 72 which extend laterally relative to bared portion 56. Deformation of the bared portion 56 over the sharp edges 72 tends to interlock the tang with the bared portion 56 and thus enhances the mechanical connection by increasing resistance to longitudinal pull-out, while at the same time enhancing the electrical connection by breaking through any metal oxide coating on bared portion 56. Tang 70 preferably is formed by striking the tang from the material of the terminal 30 at platform 32, as by lancing. Serrations 74 extend laterally along the platform face 36 to grip bared portion 56 and further enhance the mechanical connection, while serving to break through any further metal oxide coating on bared portion 56 so as to enhance the electrical connection.

The presence of tang 70 facilitates the effective connection of spade lug 52 at section 22. Ordinarily, the torque applied by the clamping face 64 of the screw head 60 to the spade lug 52, when the spade lug 52 is clamped between the screw head and the platform, tends to push the spade lug longitudinally out from between the screw head and the platform. By providing tang 70, and preferably a pair of tangs 70 extending in opposite lateral directions at either side of the aperture 66, the resilient clamping forces generated by deflection of the tangs 70 will tend to confine the spade lug 52 between the screw head and the platform. Moreover, the sharp edges 72 will tend to dig into the spade lug to maintain a good mechanical and electrical connection.

Where ring lug 50 is to be connected to section 20, tangs 70 are effective to defeat the tendency for the ring lug 50 to rotate about axis A of the clamping screw 60 during tightening of the connection. Such rotation could bring the ring lug or the wire to which ring lug 50 is affixed close enough to the next adjacent wire or its associated circuit to increase the possibility of a short circuit between the wires. Here again, the resilient clamping forces generated by the tangs 70 will tend to preclude such deleterious rotation while the biting action of the sharp edges 72 enhances the effectiveness of the tangs. Similar advantages are attained in connecting the alternate element 58 of the quick-connect device.

Figure 5:
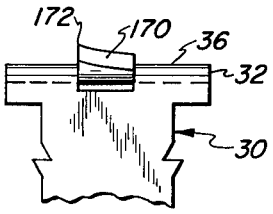
FIG. 5 is a fragmentary side elevational view of a portion of a terminal member showing an alternate construction.

Turning now to FIG. 5, an alternate construction is illustrated in which a tang 170 is twisted about a lateral axis coincident with the lateral extent of the tang (perpendicular to the plane of the paper) so as to raise the sharp edge 172 relative to the remainder of the tang and thereby present the sharp edge for better biting action. By thus raising the sharp edge 172 toward the clamping surface, the sharp edge more effectively can dig into the calmped conductive element. Furthermore, the twisted tang 170 will exhibit a greater resistance to deflection and thus establish a higher resilient clamping force.

Figure 6:
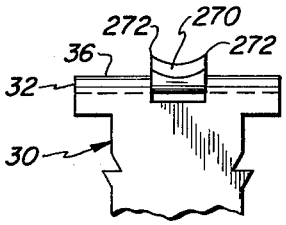
FIG. 6 is a fragmentary side elevational view of another portion of a terminal member showing another alternate construction.

Another alternate construction is shown in FIG. 6 wherein tang 270 is deformed into a concave transverse cross-sectional configuration to raise the sharp edges 272 at the extremities of the concave transverse cross-sectional configuration relative to the remainder of the tang 270. In this manner two sharp edges 272 more effectively can dig into the clamped conductive element, while the tang 270 is stiffened so as to establish a higher resilient clamping force.

It is to be understood that the above detailed description of embodiments of the invention is provided by way of example only. Various details of design and construction may be modified without departing from the true spirit and scope of the invention, as set forth in the appended claims.

I claim:

1. In an electrical terminating device of the type having an electrical terminal member and a clamping means for detachably connecting a conductive element to the terminal member, the improvement comprising:

an electrical terminal member having a platform for receiving a conductive element to be detachably connected to the terminal member;

clamping means including a clamping surface juxtaposed with the platform and selectively movable toward and away from the platform for selectively clamping or releasing the conductive element from between the clamping surface and the platform when the conductive element extends in a longitudinal direction between the clamping surface and the platform;

at least one resiliently deflectable cantilevered projection unitary with the terminal member and extending laterally relative to said longitudinal direction, said tang having a remotely extending free end and a pair of opposed side edges, each of said side edges being spaced inwardly from the longitudinal extremities of said platform, said tang extending upwardly toward the clamping surface, and at an acute angle to the platform such that upon clamping the conductive element between the clamping surface and the platform, the projection will be deflected resiliently and will establish a resilient clamping force upon the conductive element tending to confine the conductive element between the clamping surface and the platform.

2. The invention of claim 1 wherein the projection includes at least one relatively sharp edge confronting the clamping surface such that the conductive element will be engaged by the sharp edge when clamped between the clamping surface and the platform.

3. The invention of claim 2 wherein the projection is a tang unitary with the platform and struck from the material thereof.

4. The invention of claim 3 wherein the tang is twisted about an axis coincident with the lateral extent of the tang to raise the sharp edge relative to the remainder of the tang.

5. The invention of claim 3 wherein the tang includes two relatively sharp edges confronting the clamping surface such that the conductive element will be engaged by the sharp edges when clamped between the clamping surface and the platform.

6. The invention of claim 5 wherein the tang is deformed into a concave transverse cross-sectional configuration to raise the sharp edges at the extremities of said configuration relative to the remainder of the tang.

7. The invention of claim 1 including two resiliently deflectable cantilevered projections unitary with the contact member and extending laterally in opposite directions.

8. The invention of claim 7 wherein each projection is a tang unitary with the platform and struck from the material thereof.

9. The invention of claim 8 wherein the tangs each include a relatively sharp edge confronting the clamping surface such that the conductive element will be engaged by the sharp edges when clamped between the clamping surface and the platform.

10. The invention of claim 9 wherein each tang is twisted about an axis coincident with the lateral extent of the tang to raise the sharp edge thereon relative to the remainder of the tang.

11. The invention of claim 8 wherein the tangs each include two relatively sharp edges confronting the clamping surfaces such that the conductive element will be engaged by the sharp edges when clamped between the clamping surface and the platform.

12. The invention of claim 11 wherein the projections are each deformed into a concave transverse cross-sectional configuration to raise the sharp edges at the extremities of said configuration relative to the remainder of the tang.

13. The invention of claim 1 wherein:

the platform includes a threaded aperture; and the clamping means includes a threaded fastener element received within the aperture for moving the clamping surface toward and away from the platform in response to rotation of the fastener element within the aperture.

14. The invention of claim 13 wherein the contact member includes a lug integral with the platform and extending in a direction generally normal to the platform.

* * * * *